United States Patent [19]

Bratko

[11] 4,314,542

[45] Feb. 9, 1982

[54] INFRA-RED DOMESTIC FURNACE

[75] Inventor: Rudolph S. Bratko, Hinckley, Ohio

[73] Assignee: Slyman Manufacturing Corporation, Parma, Ohio

[21] Appl. No.: 187,776

[22] Filed: Sep. 16, 1980

Related U.S. Application Data

[60] Division of Ser. No. 935,500, Aug. 21, 1978, Pat. No. 4,252,520, which is a continuation of Ser. No. 687,754, May 19, 1976, which is a continuation-in-part of Ser. No. 378,335, Jul. 11, 1973, abandoned, which is a continuation-in-part of Ser. No. 261,681, Jun. 12, 1972, abandoned.

[51] Int. Cl.[3] ..... F24H 3/06

[52] U.S. Cl. ..... 126/110 R; 431/170; 431/328

[58] Field of Search ..... 126/110 R, 110 B, 116 R; 431/328, 327, 100, 160, 7, 170

[56] References Cited

U.S. PATENT DOCUMENTS

| | | | |
|---|---|---|---|
| 742,879 | 11/1903 | Lawler | 431/170 X |
| 3,248,099 | 4/1966 | Bratko | 431/329 X |
| 3,330,323 | 7/1967 | Dennis | 431/170 X |
| 3,434,791 | 3/1969 | Hayashi et al. | 431/328 |
| 3,507,481 | 4/1970 | Hemmert | 126/110 R X |
| 3,527,199 | 9/1970 | Perry et al. | 431/328 X |
| 3,751,213 | 8/1973 | Sowards | 431/328 |
| 3,884,617 | 5/1975 | Virr | 431/170 |

*Primary Examiner*—William E. Tapolcai, Jr.
*Attorney, Agent, or Firm*—Pearne, Gordon, Sessions, McCoy & Granger

[57] ABSTRACT

There is disclosed a furnace which is particularly suitable for domestic use, having means to generate infra-red radiation in a sealed combustion chamber to thereby rapidly heat the same and in turn impart that heat to air ciculated therearound, and ultimately directed to the area to be heated, the combustion arrangement including a fibrous pervious burner member to and through which an air/gas mixture under pressure is directed and caused to burn over the surface thereof to effect the infra-red heat generation, the same effecting greatly improved heating efficiency, reduction in air pollution and a decreased demand for fuel to provide for heating of given area.

1 Claim, 6 Drawing Figures

INFRA-RED DOMESTIC FURNACE

This is a division of application Ser. No. 935,500, filed Aug. 21, 1978, now U.S. Pat. No. 4,252,520, which was a continuation of application Ser. No. 687,754, filed May 19, 1976, which was a continuation-in-part of application Ser. No. 378,335, filed July 11, 1973, now abandoned which was a continuation-in-part of application Ser. No. 261,681, filed June 12, 1972, now abandoned.

OBJECTS OF THE INVENTION

It is a principal object of this invention to provide a domestic type heating furnace of the power class, in which an infra-red generator is provided to cause the heating of an enclosure, which in turn is in a position so that air may be forced over the same to particularly pick up as much of the heat generated, as possible, direct the heated air thus additionally over and through a radiator and to a plenum from which the same may be distributed to a place of use.

It is a further object of this invention to provide a novel form of heat exchanger, in which the shape of the enclosure forming the outer portions thereof is such as to particularly increase the surface interiorly thereof with a sealed burner unit which will generate the infra-red heat, and in turn impart that infra-red generation to the enclosure forming the heat exchanger, air/gas mixture under pressure is delivered to the burner unit and caused to burn uniformly over the surface thereof in a sealed area whereby the products of combustion are effectively used to heat various radiating elements, and the ultimate disposition of such products is exteriorly of the building in which the furnace is placed, without absorbing air from the interior of the building and thus wasting the same to the atmosphere.

Another object of the invention is to provide a novel burner unit which is comprised of a hat-shaped fibrous matrix, which in turn is mounted on a cooling drum, the cooling drum further being effectively sealed with relation to such unit, and through which drum extends orifice means by which the air/gas mixture, under pressure, is delivered to the burner unit and caused to burn over the surface of the matrix and interiorly in a sealed area of the enclosure of the heat exchanger unit, not being affected by air around the furnace as such as far as the combustion aspects are concerned, all of the same incorporated in a relatively small unit providing efficient generation of heat which is by ultimately availing of the convection and the air thus heated delivered to a place of use.

Another object of the invention is to provide a novel arrangement of the respective parts, including the enclosure of the heat exchanger unit in which the hat-shaped matrix is sealed, and to which matrix is supplied an air/gas mixture regulated in accordance with the best principles and under suitable pressure to provide the generation of infra-red heat because of the composition of the hat-shaped body itself and the uniformly arranged composition of the same which causes the gas to burn over the surface in a uniform manner and to thereby uniformly generate infra-red generation therearound, to in turn impart the same to the enclosure and thus to air passed therearound and to an ultimate place of use.

Other and further objects of the invention will be understood from a consideration of the specification appended hereto and disclosed in the drawing wherein.

DESCRIPTION OF THE INVENTION

Figure 1:
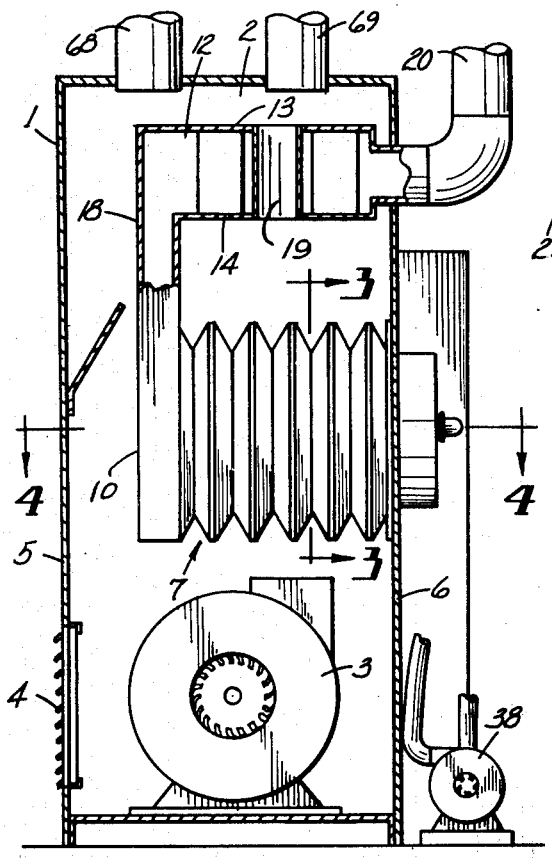
FIG. 1 is a sectional view of a furnace with certain aspects disclosed in their ultimate relationship, including the means for circulating the air over the heat exchanger, the blowing elements for supplying an air/gas mixture to the heat exchanger and burner therewithin, radiator elements and plenum as well as the main enclosure of the furnace itself.
Figure 2:
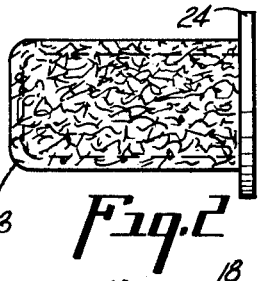
FIG. 2 is a view of the matrix or hat-shaped burner matrix to illustrate its general configuration.
Figure 3:
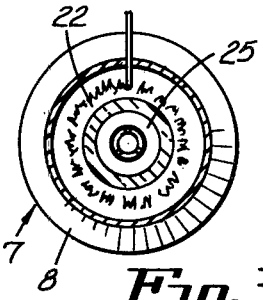
FIG. 3 is a sectional view, about on the line 3—3 of FIG. 1 looking in the direction of the arrows.

Referring now to FIG. 1, there is disclosed a generally rectilinear enclosure designated 1, in this case being in upright position, and having a plenum area 2 at the upper portion thereof, a blower for circulating the air over and around the ultimately to be described heat generating unit and said blower being designated 3 and of sufficient capacity and power to provide for circulation of air in any desired manner. The air is supplied to the blower through a louvered opening 4 in the rear wall 5 of the main housing 1.

Figure 4:
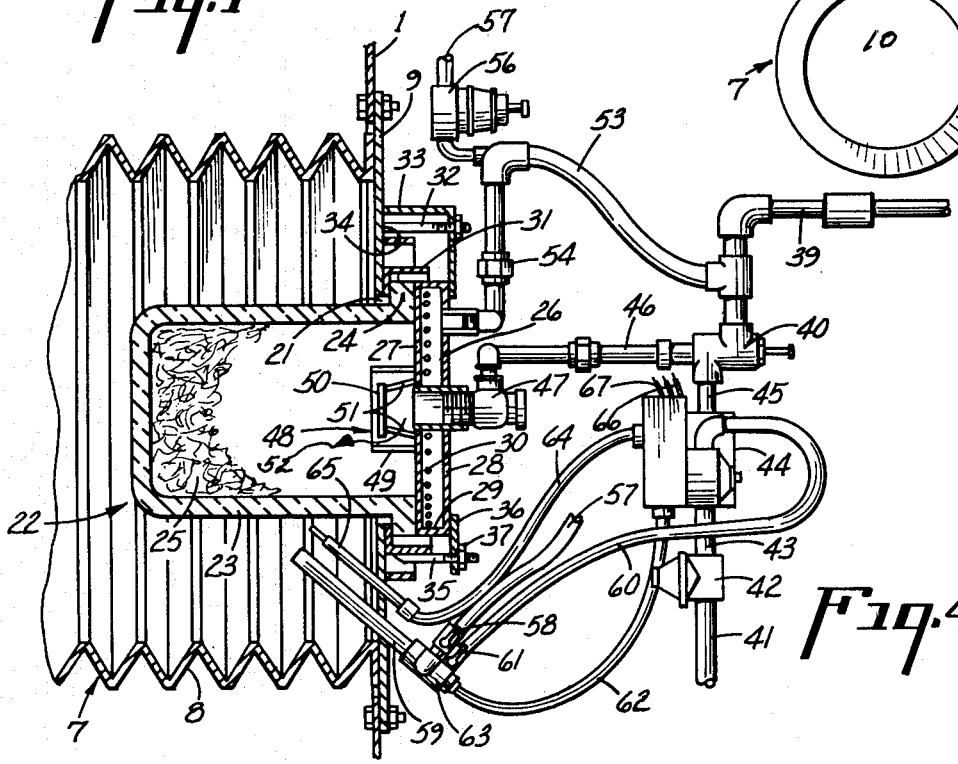
FIG. 4 is a somewhat enlarged sectional view, likewise fragmentary in nature, illustrating in greater detail the construction and arrangement of the heat exchanger unit, the burner unit therewithin and the various controls in relation thereto.

The front wall 6 of the housing 1 is provided to support the mechanism and elements now to be described, and particularly having reference to FIG. 4.

The heat exchanger unit generally designated 7, in FIG. 4, is substantial cylindrical in cross section as viewed from the right-hand side thereof; however the exterior and interior configuration of this heat exchanger unit, including the enclosure 8 is designed to have the most surface possible exposed to air passing thereover and as such may be termed corrugated as to its exterior, with the interior following the same configuration since the enclosure is formed of relatively thin gauge material such as 16-gauge steel or the like.

At the one end of the enclosure 8, the same is provided with a mounting flange 9 in the form of a circular plate to which the end of the corrugated body is suitably fastened as by welding, brazing or the like.

At the other end, the enclosure 8 is provided with a flat plate enclosing part 10, and extending upwardly therefrom is a suitable rectangular pipe connection 11 leading to a radiator 12.

Figure 5:
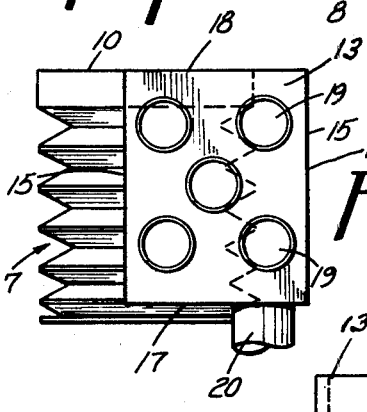
FIG. 5 is a view taken about on the line 5—5 of FIG. 1, looking in the direction of the arrows.
Figure 6:
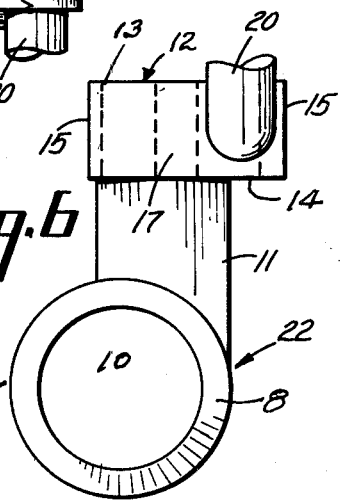
FIG. 6 is a view of the heat exchanger and radiator connected thereto as though removed from the furnace.

The radiator 12 is as shown in top plan view in FIG. 5, rectangular and of hollow configuration having the top 13 and bottom 14 with the sides 15 and 16 and an end 17 with the back 18 forming a rectilinear enclosure; in this case, however, the same having extending therethrough the series of passages 19, so that air may pass therethrough, these passages being sealed and as to the interior of the radiator 12, providing an enclosure through which the products of combustion to be ultimately described, will pass and thence outwardly through a stack connection 20 in somewhat conventional manner.

Referring again to FIG. 4, the same discloses the mounting plate 9 as having supported therefrom in an opening 21 extending therethrough, a burner unit generally designated 22, which burner unit is of particular special form now to be described in detail.

The burner unit 22 includes the hat-shaped body better described as a matrix 23 which is of a previous self supporting material, in this case being a fibrous molded member of alumina silica composition, having a substantial chromic oxide content, having been found particularly suitable for the purposes hereof.

As will be understood from a consideration of this Figure, this hat-shaped member 23 includes the flange 24 thereof extending around the same—this matrix 23 being cylindrical basically and hollow so as to have the interior 25 thereof relatively of a large area or volume.

The flange 24 is in turn, for the purposes hereof, saturated to a substantial extent with a sealing material comprising a colloidal silicate, one form of which is produced by Nalco Chemical Company, Chicago, Illinois, and known as Nalcoag Type 1115, this flange in turn being engaged with and seated on or against a cooling drum generally designated 26.

The cooling drum 26, is for the purposes hereof, a flat, relatively short, cylindrical member having the back wall 27 and front wall 28 with a peripheral connecting wall 29 arranged and circularly configured so as to substantially conform with the periphery of the hat-shaped matrix 23.

The peripheral wall 29 of the cooling drum 26 is provided with a series-of holes therethrough, designated 30 for purposes which will appear subsequently.

Extending around the periphery of the flange 24 of the matrix 23 and the wall 29 of the drum 26, is an angular member 31 which is slightly spaced from the peripheries mentioned so that air passing through the openings 30 in the cooling drum 26 will be directed to the space therebetween, and in turn be effective to cool the periphery of the flange 24 of the matrix 23 as well as the surfaces of the drum for purposes which will appear as this description proceeds.

In order to maintain the drum and matrix, as well as the member 31 in connection with the mounting plate 9, suitable bolts and angle members 32 and 33 respectively are availed of, the bolts being fastened to the mounting plate 9 at 34, with the angle 33 extending over the cooling drum surface 28 and a series of these being provided to maintain the same in position.

The cooling drum is maintained in connection with the member 31 by means of suitable studs 35 and arms 36 maintained by nuts 37 on the studs 35, the studs in turn being welded or otherwise secured to the member 31.

Thus, the assembly heretofore described is maintained in the position shown and may be removed by suitable application of wrenches to the various nuts as the occasion may demand.

Now to be described, is the means for supplying an air/gas mixture to the burner or matrix 23 with the various piping and controls required therefor; first of all being pointed out the fact that a suitable centrifugal blower designated 38 is provided to supply the necessary air as required, and in this case the same is directed to a pipe such as 39 and thence to an air/gas mixing valve 40.

The valve 40 is in turn supplied by gas from the usual pipeline, in this case being directed to a pipe 41 through a pressure regulator 42, piping 43, to a valve known as a baso valve, in this case being a Penn-Baso redundant gas valve, Model G-60 CAG-1 preferably, and designated for the purposes hereof as 44. This valve will operate in accordance with known principles and for the purposes suggested as this description proceeds.

The pipe 45 is suitably connected so as to supply the gas from the valve 44 to the mixing valve 40.

From the valve 40, by piping such as 46, the air/gas mixture which is proportioned in this valve 40, is directed to a burner orifice unit 47 which is mounted in the drum 26 previously mentioned, and extends therethrough so that the air/gas mixture directed and regulated by such orifice unit 47 passes interiorly into the matrix 23, in this case being controlled as to distribution by a diffuser or baffle unit 48 which comprises a cylindrical element 49 fastened to the inner wall 27 of the drum 26, a plate 50 mounted on spacers 51 against which the gas impinges and follows the arrows such as 52 outwardly and into and through the matrix 23 so as to be distributed uniformly therethrough and thereover.

Air from the blower 38 is also directed through piping such as 53 to the cooling drum 26 as by means of the piping 54, and in addition the air is also directed to a pressure regulator 56 and piping 57 under the control of a valve 58 to a pilot unit 59 which extends through the mounting plate 9 and into the interior of the enclosure 8 of the heat exchanger 7.

Gas is supplied to the pilot from the baso valve through a line 60 under the control of a valve 61.

A suitable spark igniting system is controlled also by the baso valve and the lead 62 is directed to the igniter unit 63 which in conjunction with the gas connections causes the pilot 59 to be lighted as desired and under the control of a thermostat or other means not shown here in detail, but readily supplied by those skilled in the art, and particularly of course controlling the baso valve for the purposes of such an arrangement; namely to turn the gas on and off when heat is demanded and likewise to control the air as will be apparent hereinafter.

In order to provide for sensing the situation within the heat exchanger 7, a pilot flame rod protector fires only during the burner cycle and is connected by means of the connections such as 64 and the flame rod unit extending into the interior of the heat exchanger designated 65.

Suitable leads such as 66 and 67 extend to the thermostat control and lead to the baso valve for controlling the various elements heretofore described in accordance with known desired procedure in operating a domestic furnace of this type.

In this particular instance, the air/gas mixture is pressurized for natural gas at about 5 inches, and regulated to be maintained thereat so that the gas/air mixture passing into the interior of the matrix 23 will be at that pressure and be ignited and burn over the surface of the matrix in a uniform manner so as to produce desired infra-red radiation, which in turn is transmitted to the enclosure 8 and the corrugations thereof.

By suitably operating the blower 3 initially described, air is caused to pass up, around and over the heat exchanger 7 and in turn the radiator 12 positioned thereabove, so that the maximum amount of exposure of the air to heated surfaces is accomplished, the radiator of course adding to the surface of the heat exchanger and the circulating openings therethrough designated 19 likewise promoting circulation to the plenum 2 for distribution through the piping such as 68 and 69 to the ultimate areas to be served for heating of the furnace.

It has been found that in the operation of this furnace, the volume of natural gas required is relatively minimal for a given heat output, and in fact compares so favorably with known furnaces as to be much more effective in the ultimate utilization of the heating values of gas as to be substantially less in quantity, even almost 40% to 50% less gas being required to produce a given amount of heat for the particular purposes hereof.

In using this particular furnace, it has also been found that the emissions of NO and $NO_x$ is very substantially reduced, and in fact to below 15 (PPM) with CO being likewise reduced and maintained necessarily at a very low value.

The same relative values are true in the use of natural gas and Propane, the volume of Propane being somewhat less per hour requirement than that of natural gas as would be expected.

This furnace has been embodied in a working furnace, and is operating in accordance with the various means and parts described herein so as to produce in a novel manner the infra-red radiation transmitted to the heat exchanger, and thereby by convection elevating the temperature of the air more efficiently than has heretofore been the case, particularly since it is borne in mind that there is no room air used for combustion purposes—all this air being brought from outside through the centrifugal blower 38, the only air being circulated being that previously in the room and not requiring heating of outside air or using the already heated air for combustion purposes. This is particularly advantageous as established hereby by reason of the fact that this is a sealed burner unit, and the burner produces the infra-red radiation in a sealed area, through a novel form of matrix, so that efficient production of infra-red generation is provided.

I claim:

1. In a furnace comprising a main housing, a distributing plenum therein, a heat exchanger in the housing to heat air for the plenum, means to circulate air from outside the enclosure around and past the heat exchanger and to said plenum, said heat exchanger comprising an enclosure with a heat-radiating surface and a burner unit extending into the heat exchanger, the improvement wherein said unit is sealed with respect to the interior of the exchanger to provide a combustion chamber sealed from communication with the plenum and ambient air, and said burner unit is constructed of a hollow fibrous porous matrix having a closed end and an open end, the closed end being located within the heat exchanger, and further comprises means, including a plate, closing the open end of the matrix, an inlet for a combustible gas-air mixture extending through the plate into the open end of the matrix, structure defining an air chamber adjacent said plate and matrix and having peripheral outlet means adjacent the open end of the matrix, said matrix having a peripheral marginal portion near its open end exposed to air flowing from said chamber through said outlet means, and means to supply a pre-mixed air-gas mixture under pressure greater than atmospheric pressure, including air from a source remote from the heat exchanger, to the burner unit to produce infra-red radiation, said matrix being an alumina silica composition including chromic oxide, said matrix including a flange at the open end of the same composition as the matrix, the flange being saturated with a sealing material comprising a colloidal silicate that inhibits penetration of the air-gas mixture.

* * * * *